United States Patent [19]

Ippoliti et al.

[11] 4,319,308

[45] Mar. 9, 1982

[54] HELMET FOR PROVIDING A SENSORY EFFECT TO AN OBSERVER

[76] Inventors: Augusto Ippoliti; Silvana Lisotti, both of via di Quarto 34, Bagno a Ripoli (FI), Italy

[21] Appl. No.: 92,213

[22] Filed: Nov. 7, 1979

[30] Foreign Application Priority Data

Nov. 10, 1978 [IT] Italy ..... 11872/78[U]

[51] Int. Cl.[3] ..... F21L 15/14

[52] U.S. Cl. ..... 362/106; 2/412; 2/199; 362/390

[58] Field of Search ..... 2/199.1, 412; 362/106, 362/390

[56] References Cited

U.S. PATENT DOCUMENTS 3,309,691 3/1967 Bonanno ..... 362/106

*Primary Examiner*—Stephen J. Lechert, Jr.

*Attorney, Agent, or Firm*—McAulay, Fields, Fisher, Goldstein & Nissen

[57] ABSTRACT

A helmet for motorcyclists for providing a sensory effect to observers. The helmet is provided with an inner portion and an outer portion which are spaced from each other to provide for an interspace between the two portions. Positioned within the two portions is a light emitting device, a tape player, and power source in the form of a battery. One or more switches may be provided on the outer portion which interconnects the light source with the battery or the tape player with the battery or both to provide the light and/or sound effect in the interspace. The outer portion may be formed from material which is partially or wholly transparent, or translucent with some opaque portions. Character emitting openings may be provided on the outer portion and the outer portion may have different colors or the light may be of different colors to provide different light sensory effects to the observer. The inner and outer portions may also be provided with openings for the sound to go out of the interspace between the inner and outer portions.

12 Claims, 2 Drawing Figures

HELMET FOR PROVIDING A SENSORY EFFECT TO AN OBSERVER

BACKGROUND OF THE INVENTION

This invention relates to a helmet of the type particularly useful for motorcyclists for providing a sensory effect to an observer. More particularly, the invention is concerned with a helmet having an inner rigid head protecting portion and an outer portion which can be rendered luminous and provide for a sound effect output.

In general, helmets for motorcyclists are made to provide protection for the head of the wearer. In addition, some helmets are also provided with means for attracting the attention on the part of those who look at the helmet as well as to provide an outer pleasing effect while at the same time providing suitable protection for the head of the wearer.

To these ends, the present invention consist in the provision of a helmet in which an inner portion is adapted to fit the head of the wearer and is formed from a hard impact resistant material, and an outer portion spaced from and connected with the inner portion to provide a free interspace between the inner portion and the outer portion, and sensory impression emitting means are positioned within the free interspace to provide sensory indicators ascertainable from the outside of the outer portion.

Additionally, the sensory impression emitting means provides a sensory effect to the observer. For this purpose, positioned within the interspace is a light emitting source which can include one or more lights and/or a tape player to provide a sound output. Positioned within the interspace is also a source of energy such as a battery to which the light sources and tape player are connected for energization thereof. Positioned on the outside of the outer portion of the helmet are one or more switches. A single three-way switch can be used to activate all of the light sources and tape player, or a plurality of switches can be used in which a single switch is used for each light source and a single switch is used for the tape player.

To provide the outer aspect which is desired, the outer portion of the helmet is provided with a base portion which is opaque so that the tape player, light sources, battery and interconnecting circuitry are not visible from the outer portion of the helmet.

The outer portion may be formed of transparent or translucent material in those portions which are not opaque to provide for the transmission or diffusion of light, as desired. In addition, certain figures or characters are provided on the outer portion which may be made opaque or transparent when the remaining portion is made translucent, or translucent when the remaining portion is made transparent to provide different visual effects with respect to the emitted light. Additionally, other openings to provide speakers openings or sound openings are provided in the outer portion to provide for the emission of sound from the tape player. The inner portion may also be provided with openings for the emission of sound from the tape player.

While it has been indicated that a tape player can be placed into the interspace in the helmet, it is equally possible to use a tape recorder because these types of instruments are substantially identical. Additionally, the light sources, tape player, and battery may be placed into a chamber which is formed in the interspace between the inner and outer portions of the helmet.

The different light emitting or exit openings may be made in the form of characters, numerals or any other suitable design. To enchance the amount of light which is emitted from the outer portion and the various parts thereof, the inside surface of the inner forged portion forming one of the side of the interspace may be coated with a reflecting surface to provide for light reflection.

A primary purpose of the invention is to provide a means of attraction and attention on the part of those viewing the helmet or the wearer of the helmet. More particularly, a feature of the invention is to provide for a means of attracting attention by the wearer of the helmet when traveling in the dark.

Another feature of the invention is the use of the helmet for the display of messages such as advertising material through the illuminated figures or characters as well as by means of sounds from the tape player.

The basic outer portion or shell is preferably formed from a strong-impact resistant material such as polycarbonate. The inner portion is formed of cushion-type material to provide an appropriate covering for the head of a motorcyclist. The outer portion in accordance with invention can be formed of a strong impact resistant translucent or transparent material. This material can occupy a major portion of the helmet or be formed in strips or bands to provide for ease of visibility.

In many instances, the lights on a motorcycle or equivalent are not readily visible to others in different types of vehicles. With the helmet according to the invention, the head of the wearer which is usually at the approximate eye level of the individual in another vehicle becomes readily visible to such individual. Flashing lights can be used which are contained within an interspace between the inner and outer portions of the helmet and, the outer portion with the transparent and/or translucent portions will render the lights or flashing lights contained within the interspace visible.

A further feature of the invention is that the energy source can be contained within the interspace, or a wire can be used to connect the lights to the motorcycle battery or an external battery pack which can be carried, for example, on the belt of the helmet wearer.

While the primary purpose of the lights is to direct attention to an observer for safety purposes, it will be evident that as an acilliary feature, the lights can be used to provide a pleasing effect to such observer.

Other objects, features and advantages as well as the nature of invention will be more readily understood from the detailed description of the invention which follows, taken in connection with the accompanying drawing which illustrates the presently preferred mode of carrying out the invention.

DESCRIPTION OF THE PREFERRED EMBODIMENTS

Figure 1:
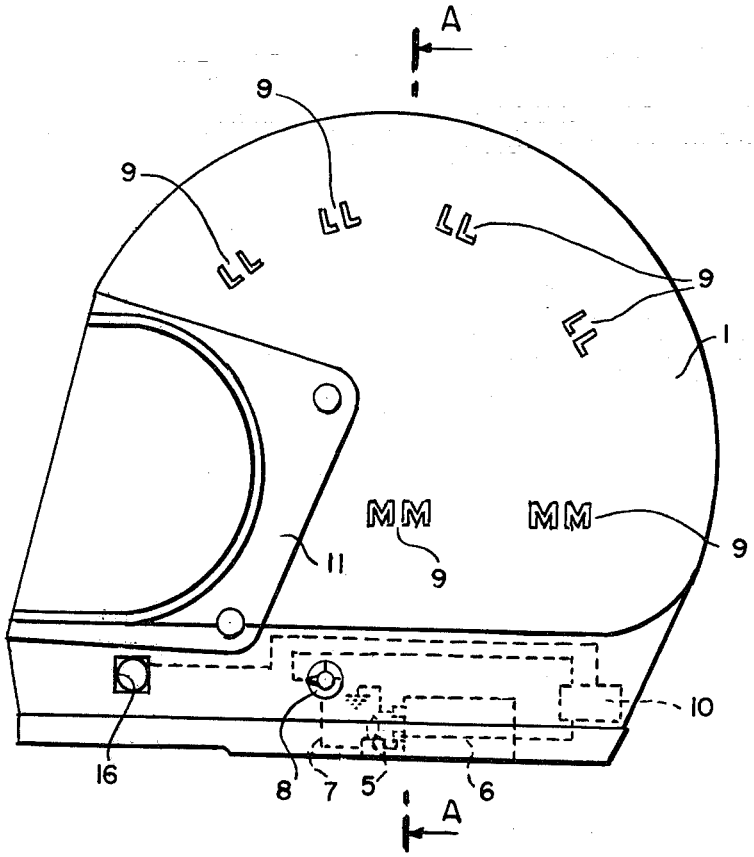
FIG. 1 is a side view, partially in section of a helmet according to the invention with a luminous outer portion and a chamber for containing the light emitting sources and/or tape player/recorder; and, FIG. 2 is a section view taken along the line A—A of FIG. 1.
Figure 2:
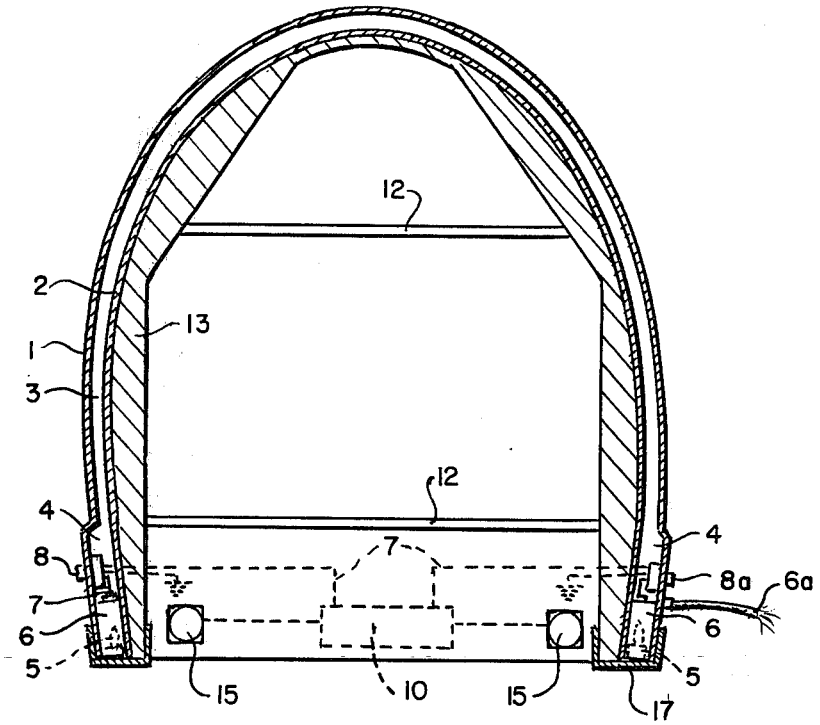

Referring now more particularly to the drawing, the helmet is provided with an outer wall or portion 1 of transparent or translucent material, suitably spaced from a resistant or impact resistant wall 2 forming an inner portion of the helmet which are spaced from each other to provide for an interspace 3 therebetween. The helmet is provided with at least one lateral base portion 4, or two lateral portions 4 or a single base portion 4 which surrounds the bottom portion of the helmet. Lateral base portion 4 includes an outer portion 1*a* which is pivotally connected with the bottom of the inner portion or the impact resistant wall 2 so that it can be opened to provide access to the interior of the interspace 3. Where the base portion 4 extends completely around the base of the helmet, then a plurality of closures 1*a* are used to provide access to the interspace and the material therein. In any event, the entire base portion 4 which forms the bottom of the outer wall 1 is desirably opaque so as to hide anything contained within the interspace of the base portion 4.

Positioned within the base portion 4 in the interspace between the outer wall 1 and the inner wall 2 is one or more light sources in the form of a micro-lamp 5, an energy source in the form of a battery 6, circuit means in the form of wires 7, and a sound device in the form of tape player/recorder 10.

Micro-switch 8 may be in the form of a three-position switch to provide for energizing the light source alone, the tape player/recorder 10 alone, or both together. Additionally, separate switches 8 in the form of micro-switches may be used to energize each of the individual light sources and the tape player/recorder.

The helmet is formed with a conventional opening and cover 11 and inner head holding portions 12 to hold the helmet to the head of the wearer. In addition, the interior portion 13 is formed with a facing wall to conform to the head of the wearer and provide the necessary impact resistance by containing impact resistant material between the inner wall 13 and the outer wall or surface 14 of the inner portion or impact resistant wall 2. The surface 14 or the outer wall of the inner portion 2 can be provided with a reflecting surface which may be accomplished by lacquering or providing a surface with sheet metal in order to provide for a reflecting specular surface so as to throw back or reflect back the light emitted by the micro-lamp(s) 5.

Outer wall 1 or outer portion 1 which is connected with the base portion 4 so as to form a complete outer portion may be made of a transparent or translucent material, and if desired of an opaque material with additional light transmission openings 9. The light transmission openings 9 are shown in the form of characters "LL" and "MM". While these two sets of letters have been shown, it is within the scope of those skilled in the art that such portions 9 may be of various configurations including both numerals, figures and other configurations. Specifically, if the outer wall or portion 1 is made opaque, the zones 9 may be made from transparent or translucent material or may be completely open. When the outer wall is made from transparent material the zones 9 may be made of opaque or translucent material, and when the outer wall is made from translucent material, the zones 9 may be made from opaque or transparent material or left empty.

Where a tape player/recorder is also contained within the base or bases 4, then a speaker opening 15 is provided on the inner portion or inner wall 2 and/or, a speaker opening 16 can also be provided in the outer wall or portion 1 so as to provide for the emission of sounds through the outer wall 1, the inner 2 to the interior of the helmet or both.

Outer wall 1 may be formed of colorless or colored material and the light emitted by lamp may be white or various colored. It will be evident that the light source or sources will illuminate the interspace between the two walls and when the reflecting material on the outer surface 14 is used, the light will be further enhanced, and depending upon whether a transparent or a translucent material is used, various forms of light transmission through the outer portion or wall 1 will take place. When the tape player is also provide, in addition to the light effects, various forms of sound effects can be provided.

The circuitry used for the connections between the battery and the light sources and tape player as well as the switches are conventional.

While a battery 6 has been shown as one form of energy source, it is possible to use an alternate source which is connected to the lights and/or tape player/-recorder so that the lamps 5 and tape player/recorder 10 can be energized externally. For this purpose, wire 6*a* is provided which can be connected with a battery pack and worn on a belt in a conventional manner. Wire 6*a* may also be connected with the battery of the motorcycle (not shown) in a conventional manner to supply the necessary power and charge battery 10, when so connected.

While there has been shown what is considered to be the presently preferred mode for carrying out the invention, it will be obvious to those skilled in the art that various changes and modifications may be made therein without departing from the scope of the invention.

We claim:

1. A helmet of the type particularly for motorcyclists for providing a sensory effect to observors, comprising:

an inner wall portion adapted to fit the head of a wearer and formed from a hard impact resistant material, an outer wall portion spaced from and connected with said inner portion to provide a free interspace between said inner portion and said outer portion, said outer wall portion substantially enclosing said inner wall portion to form said interspace between substantially the entire outer portion of said inner wall portion and the entire inner portion of said outer wall portion, and sensory impression emitting means positioned within said free interspace and variously positioned therein to provide sensory indicators ascertainable from the outside of said outer portion.

2. The helmet as claimed in claim 1, wherein said sensory impression emitting means includes a light source positioned within said interspace for illumination thereof, energy source means held within said interspace and connected with said light source, and switch means including a first portion thereof coupled with said outer portion and a second portion connected in circuit with said light source and said energy source means positioned within said free interspace, said switch means being operable to connect said light source and disconnect said light source from said energy source means whereby to illuminate said interspace when said light source is connected with said energy source means.

3. The helmet as claimed in claim 2, wherein the outer surface portion of said inner portion is covered with a light-reflecting material, and said outer portion is formed of a translucent material to diffuse the light exiting through said translucent material, the light rays from said light source impinge upon said light-reflecting material increasing the effect of the light exiting through said translucent material.

4. The helmet as claimed in claim 3, wherein said outer portion is provided with transparent portions openings through which the light exits directly to provide various different light effects, and at least part of said outer surface and said light source cooperating to provide different visual color effects.

5. The helmet as claimed in claim 1 or 2, wherein said sensory impression means includes a tape player positioned within said interspace for providing sound energy therebetween; and, switch means including a first portion external of said outer portion and secured thereto, and a second portion in said interspace connecting said tape player to an energy source for activation of said tape player.

6. The helmet as claimed in claim 5, including sound openings on said inner portion and said outer portion to permit the exit of sounds, and access means to provide access to said interspace to provide for access to the parts in said interspace.

7. The helmet as claimed in claim 1, wherein said sensory impression means includes light sources and a tape player within said interspace, a battery within said interspace, a first switch connected with said outer portion external thereof and first circuit means connecting said first switch means with said light sources and said batter, and a second switch connected with said outer portion external thereof and second circuit means connecting said second switch means with said tape player and said batter;

light emitting openings having the characteristics of figures on said outer portion through which light from said light source shines;

sound emitting openings on at least one of said inner and said outer portions through which sound from said tape player exits; and, means on at least one of said inner and said outer portions to provide access to said interspace and thereby to provide access to said light source, said tape player and said battery.

8. The helmet as claimed in claim 7, wherein said inner portion is provided with a light reflecting material on the outer surface, sound reflecting material is provided on at least one of the surfaces of said inner and said outer portions facing said interspace, at least part of said outer portion being formed of a material which is translucent to light to diffuse light therethrough, and at least part of said outer portion being opaque to conceal said tape player, said light sources and said battery, at least one of said first and second switches including means to render said tape player and said light sources operative individually and simultaneously, and said outer portion including access means to provide access to said interspace for access thereto.

9. The helmet as claimed in claim 1, including means external of said helmet for connection to a source of energy.

10. The helmet as claimed in claim 1, including a lateral base portion surrounding a bottom portion of the helmet, said lateral base portion having an opening providing access to said interspace and including an outer portion which is pivotally connected with the bottom of said inner portion forming a closure for said opening for closing off said interspace and when opened to provide access to said sensory impression emitting means.

11. The helmet as claimed in claim 10, wherein said lateral base portion extends completely around the base of said helmet and forms the bottom of said outer wall portion, and said base portion includes light transmitting means for the transmission of light through said base portion.

12. The helmet as claimed in claim 1, wherein said inner wall portion includes:

an inner wall and an outer wall surface, said inner wall forming a facing wall to conform to the head of a wearer to provide the necessary impact resistance, and said outer wall surface having thereon a reflecting surface and containing between said last-mentioned surface and said facing wall hard impact resistance material.

* * * * *